US005595851A

United States Patent [19]

Creatura et al.

[11] Patent Number: 5,595,851

[45] Date of Patent: Jan. 21, 1997

[54] CONDUCTIVE DEVELOPER COMPOSITIONS WITH COATED CARRIER PARTICLES

[75] Inventors: John A. Creatura, Ontario; Catherine A. McKnight, Penfield; Michael J. Duggan, Webster; Aron J. Cogswell, Penfield, all of N.Y.; Michael F. Cunningham, Georgetown, Canada; Thomas C. Dombroski, Rochester, N.Y.

[73] Assignee: Xerox Corporation, Stamford, Conn.

[21] Appl. No.: 493,063

[22] Filed: Jun. 21, 1995

[51] Int. Cl.[6] ..... G03G 9/113

[52] U.S. Cl. ..... 430/108; 430/137

[58] Field of Search ..... 430/108, 137, 430/120

[56] References Cited

U.S. PATENT DOCUMENTS

| | | | |
|---|---|---|---|
| 3,590,000 | 6/1971 | Palermiti et al. | 252/62.1 |
| 4,912,005 | 3/1990 | Goodman et al. | 430/108 |
| 4,935,326 | 6/1990 | Creatura et al. | 430/108 |
| 4,937,166 | 6/1990 | Creatura et al. | 430/108 |

FOREIGN PATENT DOCUMENTS

| | | | |
|---|---|---|---|
| 62-280756 | 5/1987 | Japan | 430/106.6 |

*Primary Examiner*—John Goodrow
*Attorney, Agent, or Firm*—E. O. Palazzo

[57] ABSTRACT

A conductive carrier composition comprised of a core with a coating thereover comprised of a mixture of first and second polymers, and wherein the first polymer contains a conductive component, and the second polymer contains a metal oxide.

32 Claims, No Drawings

CONDUCTIVE DEVELOPER COMPOSITIONS WITH COATED CARRIER PARTICLES

BACKGROUND OF THE INVENTION

This invention is generally directed to developer compositions, and more specifically, the present invention relates to developer compositions with coated carrier particles prepared by dry powder processes, or in situ polymerization processes. In embodiments, the present invention is directed to conductive carrier particles comprised of a core with coating thereover generated from a mixture of polymers, and wherein one of the polymers is a tribocontrast polymer comprised, for example, of a polymethylmethacrylate, a polyvinylidene fluoride, and the like with a metal oxide, such as tin oxide dispersed therein. Moreover, in another aspect of the present invention the carrier particles are prepared by a dry coating process wherein a mixture of the polymers is applied to the carrier enabling conductive, that is $10^{-7}$ to about $10^{-14}$ (ohm-cm)$^{-1}$, particles with relatively constant conductivity parameters; and also wherein the triboelectric charge on the carrier can vary significantly depending on the coatings selected. In embodiments, the present invention is directed to a conductive carrier composition comprised of a core with a coating thereover comprised of a mixture of first and second polymers, and wherein the first polymer contains a conductive component, and the second polymer contains a metal oxide component, or wherein the polymers contain contrast pigments that are not in close proximity in the triboelectric series. Developer compositions comprised of the carrier particles prepared by the dry coating process of the present invention are useful in electrostatographic or electrophotographic imaging systems, especially xerographic imaging processes. Additionally, developer compositions comprised of substantially conductive carrier particles prepared in accordance with the process of the present invention are useful in imaging methods wherein relatively constant conductivity parameters are desired. Furthermore, in the aforementioned imaging processes the triboelectric charge on the carrier particles can be preselected depending, for example, on the polymer composition applied to the carrier core.

The electrostatographic process, and particularly the xerographic process, is well known. This process involves the formation of an electrostatic latent image on a photoreceptor, followed by development, and subsequent transfer of the image to a suitable substrate. Numerous different types of xerographic imaging processes are known wherein, for example, insulative developer particles or conductive toner compositions are selected depending on the development systems used. Moreover, of importance with respect to the aforementioned developer compositions is the appropriate triboelectric charging values associated therewith as it is these values that enable continued constant developed images of high quality and excellent resolution.

Additionally, carrier particles for use in the development of electrostatic latent images are described in many patents including, for example, U.S. Pat. No. 3,590,000. These carrier particles may consist of various cores, including steel, with a coating thereover of fluoropolymers, and terpolymers of styrene, methacrylate, and silane compounds. Recent efforts have focused on the attainment of coatings for carrier particles, for the purpose of improving development quality, and also to permit particles that can be recycled, and that do not adversely effect the imaging member in any substantial manner. Many of the present commercial coatings can deteriorate rapidly, especially when selected for a continuous xerographic process where the entire coating may separate from the carrier core in the form of chips or flakes, and fail upon impact, or abrasive contact with machine parts and other carrier particles. These flakes or chips, which cannot generally be reclaimed from the developer mixture, have an adverse effect on the triboelectric charging characteristics of the carrier particles thereby providing images with lower resolution in comparison to those compositions wherein the carrier coatings are retained on the surface of the core substrate. Further, another problem encountered with some prior art carrier coatings resides in fluctuating triboelectric charging characteristics, particularly with changes in relative humidity. The aforementioned modification in triboelectric charging characteristics provides developed images of lower quality, and with background deposits.

There are also illustrated in U.S. Pat. No. 4,233,387, the disclosure of which is totally incorporated herein by reference, coated carrier components for electrostatographic developer mixtures comprised of finely divided toner particles clinging to the surface of the carrier particles. Specifically, there are disclosed in this patent coated carrier particles obtained by mixing carrier core particles of an average diameter of from between about 30 microns to about 1,000 microns, with from about 0.05 percent to about 3.0 percent by weight, based on the weight of the coated carrier particles, of thermoplastic resin particles. The resulting mixture is then dry blended until the thermoplastic resin particles adhere to the carrier core by mechanical impaction, and/or electrostatic attraction. Thereafter, the mixture is heated to a temperature of from about 320° F. to about 650° F. for a period of 20 minutes to about 120 minutes, enabling the thermoplastic resin particles to melt and fuse on the carrier core. While the developer and carrier particles prepared in accordance with the process of this patent, the disclosure of which has been totally incorporated herein by reference, are suitable for their intended purposes, the conductivity values of the resulting particles are not constant in all instances, for example when a change in carrier coating weight is accomplished to achieve a modification of the triboelectric charging characteristics; and further with regard to the '387 patent, in many situations carrier and developer mixtures with only specific triboelectric charging values can be generated when certain conductivity values or characteristics are contemplated. With the invention of the present application, the conductivity of the resulting carrier particles are substantially constant, and moreover, the triboelectric values can be selected to vary significantly, for example, from less than a positive 5 microcoulombs per gram to greater than about a positive 40 microcoulombs per gram, depending on the polymer mixture and dispersed component selected.

Insulating carrier particles with a mixture of polymeric coatings thereover, and wherein the coatings are not in close proximity in the triboelectric series are illustrated in U.S. Pat. Nos. 4,937,166 and 4,935,326, the disclosures of which are totally incorporated herein by reference. There are illustrated in these patents, for example, an insulating carrier composition with first polymer present in an amount of from about 10 percent by weight to about 90 percent by weight, and a second polymer present in an amount of from about 90 percent by weight to about 10 percent by weight, and wherein the first and second polymers are selected from the group consisting of polystyrene and tetrafluoroethylene; polyethylene and tetrafluoroethylene; polyethylene and polyvinyl chloride; polyvinyl acetate and tetrafluoroethylene; polyvinyl acetate and polyvinyl chloride; polyvinyl acetate and polystyrene; and polyvinyl acetate and polymethyl methacrylate, and with a conductivity of about $10^{-15}$ $(ohm\text{-}cm)^{-1}$. Accordingly, the aforementioned carrier particles are considered insulating.

With further reference to the prior art, carriers obtained by applying insulating resinous coatings to porous metallic carrier cores using solution coating techniques are undesirable from many viewpoints. For example, the coating material will usually reside in the pores of the carrier cores, rather than at the surfaces thereof, and therefore, is not available for triboelectric charging when the coated carrier particles are mixed with finely divided toner particles. Attempts to resolve this problem by increasing the carrier coating weights, for example, to as much as 3 percent or greater to provide an effective triboelectric coating to the carrier particles necessarily involves handling excessive quantities of solvents, and further, usually these processes result in low product yields. Also, solution coated carrier particles when combined and mixed with finely divided toner particles provide in some instances triboelectric charging values which are too low for many uses. The powder coating process of the present invention overcomes these disadvantages, and further enables developer mixtures that are capable of generating high and useful triboelectric charging values with finely divided toner particles; and also wherein the carrier particles are of substantially constant conductivity. Further, when resin coated carrier particles are prepared by the powder coating process of the present invention, the majority of the coating materials are fused to the carrier surface thereby reducing the number of toner impaction sites on the carrier material. Additionally, there can be achieved with the process of the present invention, independent of one another, desirable triboelectric charging characteristics and conductivity values; that is, for example the triboelectric charging parameter is not dependent on the carrier coating weight as is believed to be the situation with the process of U.S. Pat. No. 4,233,387 wherein an increase in coating weight on the carrier particles may function to also permit an increase in the triboelectric charging characteristics. Specifically, therefore, with the carrier compositions and process of the present invention there can be formulated developers with selected triboelectric charging characteristics and/or conductivity values in a number of different combinations.

Thus, for example, there can be formulated in accordance with the invention of the present application developers with conductivities of from about $10^{-8}$ $(ohm\text{-}cm)^{-1}$ to about $10^{-6}$ $(ohm\text{-}cm)^{-1}$ as determined in a magnetic brush conducting cell, and triboelectric charging values of from about a +5 to a +40 microcoulombs per gram on the carrier particles as determined by the known Faraday Cage technique. Thus, the developers of the present invention can be formulated with constant conductivity values with different triboelectric charging characteristics by, for example, maintaining the same coating weight on the carrier particles and changing the polymer coating ratios.

Other patents of interest include 3,939,086, which discloses steel carrier beads with polyethylene coatings, see column 6; 4,264,697, which discloses dry coating and fusing processes; 3,533,835; 3,658,500; 3,798,167; 3,918,968; 3,922,382; 4,238,558; 4,310,611; 4,397,935 and 4,434,220.

SUMMARY OF THE INVENTION

It is an object of the present invention to provide toner and developer compositions with conductive carrier particles containing a polymer mixture coating.

In another object of the present invention there are provided dry coating processes for generating carrier particles of substantially constant conductivity parameters.

In yet another object of the present invention there are provided dry coating processes for generating carrier particles of substantially constant conductivity parameters, and a wide range of preselected triboelectric charging values, and wherein the carrier particles contain two polymer coatings with the first polymer containing a conductive component dispersed therein, and the second polymer containing a metal oxide dispersed therein. The aforementioned polymer coatings can be comprised of the same components like polymethylmethacrylate, or different components like polymethylmethacrylate and polyvinylidene fluoride.

In yet a further object of the present invention there are provided carrier particles comprised of a coating with a mixture of two polymers, and wherein each polymer is similar and contains dispersed therein pigments, which pigments are not in close proximity in the triboelectric series. More specifically, an object of the present invention is the provision of carriers with a core and thereover a first and second polymer coating of, for example, polymethylmethacrylate, and wherein the first coating contains carbon black, and the second coating contains a metal oxide like tin oxide, and wherein the carbon black has a work function of about 5 electron volts, and the metal oxide has a work function of about 4 electron volts. The aforementioned polymer components of carbon black and metal oxide can be considered triboelectric contrast pigments that are not in close proximity in the triboelectric series.

In still a further object of the present invention there are provided carrier particles of conductivity characteristics comprised of a core with a coating thereover generated from a mixture of similar or dissimilar polymers.

Further, in an additional object of the present invention there are provided carrier particles comprised of a core with a coating thereover generated from a mixture of polymers wherein the triboelectric charging values are from about +5 microcoulombs to about +40 microcoulombs per gram at the same coating weight.

In another object of the present invention there are provided methods for the development of electrostatic latent images wherein the developer mixture comprises carrier particles with a coating thereover consisting of a mixture of polymers that optionally are not in close proximity in the triboelectric series, and wherein the first coating contains carbon black, and the second coating contains a metal oxide like tin oxide.

Also, in another object of the present invention there are provided positively or negatively charged toner compositions having mixed therewith carrier particles with a coating thereover of a mixture of certain polymers, and wherein each polymer contains dispersed therein dissimilar contrast pigment components.

These and other objects of the present invention are accomplished by providing developer compositions comprised of toner particles, and carrier particles prepared by a powder coating process; and wherein the carrier particles are comprised of a core with a coating thereover comprised of a mixture of polymers. More specifically, the carrier particles selected can be prepared by mixing low density porous magnetic, or magnetically attractable metal core carrier particles with from, for example, between about 0.05 percent and about 3 percent by weight, based on the weight of the coated carrier particles, of a mixture of polymers, wherein each polymer contains dispersed therein dissimilar contrast pigment component, until adherence thereof to the carrier core by mechanical impaction or electrostatic attraction; heating the mixture of carrier core particles and polymers to a temperature, for example, of between from about 200° F. to about 550° F. for a period of from about 10 minutes to about 60 minutes enabling the polymers to melt and fuse to the carrier core particles; cooling the coated carrier particles; and thereafter classifying the obtained carrier particles to a desired particle size.

In embodiments of the present invention, there are provided a conductive carrier composition comprised of a core with a coating thereover comprised of a mixture of first and second polymers, and wherein the first polymer contains a conductive component, and the second polymer contains a metal oxide; and a process for the preparation of carrier particles with substantially stable conductivity parameters which comprises (1) mixing carrier cores with a polymer mixture comprising from about 10 to about 90 percent by weight of a first polymer containing a conductive component, and from about 90 to about 10 percent by weight of a second polymer containing a metal oxide; (2) dry mixing the carrier core particles and the polymer mixture for a sufficient period of time enabling the polymer mixture to adhere to the carrier core particles; (3) heating the mixture of carrier core particles and polymer mixture to a temperature of between about 200° F. and about 550° F., whereby the polymer mixture melts and fuses to the carrier core particles; and (4) thereafter cooling the resulting coated carrier particles.

In specific embodiments of the present invention, there are provided carrier particles comprised of a core with a coating thereover comprised of a mixture of a first dry polymer component and a second dry polymer component, which may, or may not be in close proximity in the triboelectric series, and wherein the first polymer contains carbon black, and the second polymer contains a metal oxide like tin oxide. Therefore, the aforementioned carrier compositions can be comprised of known core materials, including iron, ferrites, and the like, with a dry polymer coating mixture thereover. Subsequently, developer compositions of the present invention can be generated by admixing the aforementioned carrier particles with a toner composition comprised of resin particles and pigment particles. With the present invention, it is important in preferred embodiments that the carrier particles contain a first and second polymer, which polymers are preferably of the same composition, and each of the two polymers contain dissimilar contrast pigments, which pigments are not in close proximity in the triboelectric series, such as carbon black for one polymer, and tin oxide for another polymer.

Various suitable solid core carrier materials can be selected providing, for example, that a number of objectives of the present invention are obtained. Characteristic core properties of importance include those that will enable the toner particles to acquire a positive charge or a negative charge; and carrier cores that will permit desirable flow properties in the developer reservoir present in the xerographic imaging apparatus. Also of value with regard to the carrier core properties are, for example, suitable magnetic characteristics that will permit magnetic brush formation in mag brush development processes; and also wherein the carrier cores possess desirable mechanical aging characteristics. Examples of carrier cores that can be selected include iron, steel, ferrites, magnetites, nickel, and mixtures thereof. Preferred carrier cores include ferrites, and sponge iron, or steel grit with an average particle size diameter of from between about 30 microns to about 200 microns and preferably from about 75 to about 120 microns, and which cores are available from a number of sources such as Quebec Metals, Hoeganaes Corporation, Steward Chemicals, and Powdertech Corporation.

Illustrative examples of polymer coatings selected for the carrier particles of the present invention include known polymers, such as fluorocarbons, terpolymers, and the like, reference for example the United States patents mentioned herein. Specific examples of polymers include polyvinylidenefluoride, polyvinylfluoride, polyethylene, polyvinyl chloride, polymethylmethacrylate, copolyethylenevinylacetate, copolyvinylidenefluoride tetrafluoroethylene, polymethylmethacrylate, polystyrene, mixtures thereof, and the like.

Various metal, or metal oxides can be selected, such as aluminum, tin, iron, iron oxides, aluminum oxides, tin oxides, and the like, which oxides are present in effective amounts of, for example, 50 to about 80 and preferably from about 50 to about 70 weight percent. These oxides are preferably dispersed in one of the polymer coatings. The other polymer coating contains a conductive component like carbon black in various effective amounts such as, for example, from about 10 to about 50 weight percent. Accordingly, the aforementioned carrier particles in embodiments are comprised of a core with a first polymer of polymethylmethacrylate with carbon black dispersed therein, and a second polymer of polymethylmethacrylate with tin oxide dispersed therein.

With further reference to close proximity, the choice of the polymers, or contrast pigments selected are dictated by their position in the triboelectric series, therefore, for example, one may select a first polymer, or contrast pigment with a significantly lower triboelectric charging value than the second polymer, or second contrast pigment. More specifically, not in close proximity in embodiments refers to components that are at different electronic work function values, that is they are not at the same electronic work function value. Additionally, the difference in electronic work functions is at least 0.2 electron volt, and preferably is about 2 electron volts; and moreover, it is known that the triboelectric series corresponds to the known electronic work function series for polymers, reference "*Electrical Properties of Polymers*", Seanor, D. A., Chapter 17, Polymer Science, A. D. Jenkins, Editor, North Holland Publishing (1972), the disclosure of which is totally incorporated herein by reference.

The percentage of polymer present in the carrier coating mixture can vary depending on the specific components selected, the coating weight and the properties desired. Generally, the coated polymer used contains from about 10 to about 90 percent of a first polymer, and from about 90 to about 10 percent by weight of a second polymer. Preferably, there are selected two polymers with from about 40 to 60 percent by weight of the first polymer, and from about 60 to 40 percent by weight of a second polymer, and wherein the first and second polymer are similar, such as polymethylmethacrylate. In one embodiment of the present invention, when a high triboelectric charging value is desired, that is exceeding +35 microcoulombs per gram, there is selected from about 90 percent by weight of the first polymer, such as polymethylmethacrylate, containing 70 weight percent of tin oxide, and 10 percent by weight of a second polymer, such as polyvinylidenefluoride, with 10 weight percent of carbon black. In contrast, when a lower triboelectric charging value is required, less than about +10 microcoulombs per gram, there is selected from about 10 percent by weight of the first polymer; and 90 percent by weight of the second polymer. The conductivity of the aforementioned carriers is about $10^{-8}$ (ohm-cm)$^{-1}$.

Also, these results, in accordance with a preferred embodiment of the present invention, carrier particles of relatively constant conductivities from between about $10^{-9}$ (ohm-cm)$^{-1}$ to about $10^{-7}$ (ohm-cm)$^{-1}$ at, for example, a 10 volt impact across a 0.1 inch gap containing carrier beads held in place by a magnet; and wherein the carrier particles are of a triboelectric charging value of from +5 microcoulombs per gram to +40 microcoulombs per gram, these parameters being dependent on the coatings selected, and the percentage of each of the polymers used as indicated herein.

Various effective suitable means can be used to apply the polymer to the surface of the carrier particles. Examples of typical means for this purpose include combining the carrier core material, and the polymers by cascade roll mixing, or tumbling, milling, shaking, electrostatic powder cloud spraying, fluidized bed, electrostatic disc processing, and an electrostatic curtain. Following application of the polymers, heating is initiated to permit flowout of the coating material over the surface of the carrier core. The concentration of the coating material powder particles, as well as the parameters of the heating step, may be selected to enable the formation of a continuous film of the coating material on the surface of the carrier core, or permit only selected areas of the carrier core to be coated. When selected areas of the metal carrier core remain uncoated or exposed, the carrier particles will possess electrically conductive properties when the core material comprises a metal. The aforementioned conductivities can include various suitable values. Generally, however, this conductivity is from about $10^{-15}$ to about $10^{-7}$ (ohm-cm)$^{-1}$ as measured, for example, across a 0.1 inch magnetic brush at an applied potential of 10 volts; and wherein the coating coverage encompasses from about 10 percent to about 100 percent of the carrier core.

Illustrative examples of finely divided toner resins selected for the developer compositions of the present invention include polyamides, epoxies, polyurethanes, diolefins, vinyl resins, polyesters, extruded polyesters, and polymeric esterification products of a dicarboxylic acid and a diol comprising a diphenol. Specific vinyl monomers that can be used are styrene, p-chlorostyrene vinyl naphthalene, unsaturated mono-olefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butyl acrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether, vinyl ketones inclusive of vinyl methyl ketone, vinyl hexyl ketone and methyl isopropenyl ketone; vinylidene halides such as vinylidene chloride, and vinylidene chlorofluoride; N-vinyl indole, N-vinyl pyrrolidene and the like.

As one preferred toner resin there can be selected the esterification products of a dicarboxylic acid and a diol comprising a diphenol, reference U.S. Pat. No. 3,590,000, the disclosure of which is totally incorporated herein by reference, and extruded polyesters such as illustrated in U.S. Pat. No. 5,376,494. Other preferred toner resins include styrene/methacrylate copolymers; styrene/butadiene copolymers; polyester resins obtained from the reaction of bisphenol A and propylene oxide; and branched polyester resins resulting from the reaction of dimethylterephthalate, 1,3-butanediol, 1,2- propanediol and pentaerthriol.

Generally, from about 1 part to about 5 parts by weight of toner particles are mixed with from about 10 to about 300 parts by weight of the carrier particles prepared in accordance with the process of the present invention.

Numerous well known suitable pigments or dyes can be selected as the colorant for the toner particles including, for example, carbon black, nigrosine dye, lamp black, iron oxides, magnetites, and mixtures thereof. The pigment, which is preferably carbon black, should be present in a sufficient amount to render the toner composition highly colored. Thus, the pigment particles are present in amounts of from about 1 percent by weight to about 20 and preferably from 3 to about 10 percent by weight, based on the total weight of the toner composition, however, lesser or greater amounts of pigment particles can be selected When the pigment particles are comprised of magnetites, which are a mixture of iron oxides ($FeO.Fe_2O_3$) including those commercially available as MAPICO BLACK®, they are present in the toner composition in an amount of from about 10 percent by weight to about 70 percent by weight, and preferably in an amount of from about 20 percent by weight to about 50 percent by weight.

The resin particles are present in a sufficient, but effective amount, thus when 10 percent by weight of pigment, or colorant, such as carbon black, is contained therein, about 90 percent by weight of resin material is selected. Generally, however, the toner composition is comprised of from about 85 percent to about 97 percent by weight of toner resin particles, and from about 3 percent by weight to about 15 percent by weight of pigment particles such as carbon black.

Also encompassed within the scope of the present invention are colored toner compositions comprised of toner resin particles, carrier particles and as pigments or colorants, magenta, cyan and/or yellow particles, as well as mixtures thereof. More specifically, illustrative examples of magenta materials that may be selected as pigments include 1,9-dimethyl-substituted quinacridone and anthraquinone dye identified in the Color index as CI 60720, CI Dispersed Red 15, a diazo dye identified in the Color index as CI 26050, CI Solvent Red 19, and the like. Examples of cyan materials that may be used as pigments include copper tetra-4-(octaecyl sulfonamido) phthalocyanine, X-copper phthalocyanine pigment listed in the color index as CI 74160, CI Pigment Blue, and Anthrathrene Blue, identified in the color index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, permanent yellow FGL, and the like. These pigments are generally present in the toner composition in an amount of from about 1 weight percent to about 15 weight percent based on the weight of the toner resin particles.

For further enhancing the positive charging characteristics of the developer compositions described herein, and as optional components there can be incorporated herein charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; U.S. Pat. No. 4,560,635, the disclosure of which is totally incorporated herein by reference; and other similar known charge enhancing additives. These additives are usually incorporated into the toner in an amount of from about 0.1 percent by weight to about 20 percent by weight.

The toner composition of the present invention can be prepared by a number of known methods including melt blending the toner resin particles, and pigment particles or colorants of the present invention followed by mechanical attrition. Other methods include those well known in the art such as spray drying, melt dispersion, dispersion polymerization and suspension polymerization. In one dispersion polymerization method, a solvent dispersion of the resin particles and the pigment particles are spray dried under controlled conditions to result in the desired product. Toner particle sizes of from about 7 to about 20 and preferably from about 10 to about 15 microns are achieved subsequent to pulverization and classification.

Also, the toner and developer compositions of the present invention may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. No. 4,265,990, the disclosure of which is totally incorporated herein by reference, and other similar layered photoresponsive devices. Examples of generating layers are trigonal selenium, metal phthalocyanines, metal free phthalocyanines and vanadyl phthalocyanines. As charge transport molecules, there can be selected the aryl diamines disclosed in the '990 patent. Also, there can be selected as photogenerating pigments, squaraine compounds, thiapyrillium materials, and the like. These layered members are conventionally charged negatively thus requiring a positively charged toner. Other photoresponsive devices useful in the present invention include polyvinylcarbazole 4-dimethylaminobenzylidene, benzhydrazide, 2-benzylidene-aminocarbazole, 4-dimethamino-benzylidene, (2-nitro-benzylidene)-p-bromoaniline; 2,4-diphenyl-quinazoline, and 1,2,4-triazine, 1,5-diphenyl-3-methyl pyrazoline. One imaging test fixture is comprised of an aluminum substrate, a photogenerating layer of trigonal selenium dispersed in polyvinyl carbazole thereover, and a charge transport layer of N,N'-diphenyl-N,N'-bis(3-methylphenyl)[1,1-biphenyl]-4,4'-diamine, 50 percent by weight, dispersed in 50 percent by weight of polycarbonate. Moreover, the developer compositions of the present invention are particularly useful in electrostatographic imaging processes and apparatuses wherein there is selected a moving transporting means and a moving charging means; and wherein there is selected a deflected flexible layered imaging member, reference U.S. Pat. Nos. 4,394,429 and 4,368,970, the disclosures of which are totally incorporated herein by reference.

Images obtained with this developer composition had acceptable solids, excellent halftones and desirable line resolution with acceptable or substantially no background deposits.

With further reference to the process for generating the carrier particles illustrated herein, there is initially obtained, usually from commercial sources, the uncoated carrier core and the polymer coatings. The individual polymer components for the coating are available, for example, from Autochem Inc. as 301F KYNAR®, PMMA (polymethylmethacrylate) available from Soken Chemical, and other sources. The tin oxide selected was obtained from Mitsubishi Chemicals. Generally, the polymers are blended with various effective amounts of pigment dispersant, for example about 70 weight percent of tin oxide and 20 weight percent of carbon black. The blending can be accomplished by numerous known methods including, for example, a twin shell mixing apparatus. Thereafter, the carrier core polymer blend of a first polymer with carbon black, and a second polymer with tin oxide is incorporated into a mixing apparatus, about 1 percent by weight of the powder to the core by weight in a preferred embodiment, and mixing is affected for a sufficient period of time until the polymer blend is uniformly distributed over the carrier core, and mechanically or electrostatically attached thereto. Subsequently, the resulting coated carrier particles are metered into a rotating tube furnace, which is maintained at a sufficient temperature to cause melting and fusing of the polymer blend of a first polymer with carbon black, and a second polymer with tin oxide to the carrier core.

The following Examples are being provided to further define the present invention, it being noted that these Examples are intended to illustrate and not limit the scope of the present invention. Parts and percentages are by weight unless otherwise indicated. Examples I to IV illustrate a progression to some of the Examples thereafter, such as Example VII.

EXAMPLE I

There were prepared carrier particles by coating 68,040 grams of a Hoeganese atomized steel core, 90 microns in diameter, with 612 grams of a polymethylmethacrylate containing 10 weight percent of tin oxide, 1 percent coating weight, by mixing these components for 60 minutes in a Munson MX-1 Minimixer, rotating at 27.5 RPM. There resulted uniformly distributed and electrostatically attached, as determined by visual observation, on the carrier core the polymethylmethacrylate/tin oxide. Thereafter, the resulting carrier particles were metered into a rotating tube furnace at a rate of 400 grams/minute. This furnace was maintained at a temperature of 400° F. thereby causing the polymer/tin oxide to melt and fuse to the core.

A developer composition was then prepared by mixing 96 grams of the above prepared carrier particles with 4 grams of a toner composition comprised of 86 percent by weight of a styrene butadiene copolymer resin, 88 percent by weight of styrene, 12 percent by weight of butadiene, 6 weight percent of VISCOL 550P polypropylene wax, 8 percent by weight of REGAL 330® carbon black, and 2 percent by weight of the charge additive distearyl dimethyl ammonium methyl sulfate; and surface additives of AEROSIL® fumed silica, 1 weight percent, and zinc stearate 1 weight percent. Thereafter, the triboelectric charge on the carrier particles was determined by the known Faraday Cage process, and there was measured on the carrier a charge of +46 microcoulombs per gram. Further, the conductivity of the carrier as determined by forming a 0.1 inch long magnetic brush of the carrier particles, and measuring the conductivity by imposing a 10 volt potential across the brush was $10^{-9}$ $(\text{ohm-cm})^{-1}$.

In all the working Examples, the triboelectric charging values and the conductivity numbers were obtained in accordance with the aforementioned procedure.

EXAMPLE II

The procedure of Example I was repeated with the exception that there was selected a carrier polymer of polymethylmethacrylate with no tin oxide, the tribo was +50, and the conductivity was $10^{-15}$ (ohm-cm)$^{-1}$, thus the carrier was insulating.

EXAMPLE III

The procedure of Example I was repeated with the exception that there was selected a carrier polymer of polymethylmethacrylate with 30 weight percent of tin oxide, the tribo was +22, and the conductivity was $1.2\times10^{-8}$ (ohm-cm)$^{-1}$.

EXAMPLE IV

The procedure of Example I was repeated with the exception that there was selected a carrier polymer of polymethylmethacrylate with 40 weight percent of tin oxide, the tribo was +20, and the conductivity was $3.9\times10^{-8}$ (ohm-cm)$^{-1}$.

EXAMPLE V

The procedure of Example I was repeated with the exception that there was selected a carrier polymer of polymethylmethacrylate with weight percent of tin oxide, the tribo was +14, and the conductivity was $1.0\times10^{-8}$ (ohm-cm)$^{-1}$.

EXAMPLE VI

The procedure of Example I was repeated with the exception that there was selected a carrier polymer of polymethylmethacrylate with 70 weight percent of tin oxide, the tribo was a positive 10, and the conductivity was $1.5\times10^{-8}$ (ohm-cm)$^{-1}$.

EXAMPLE VII

The procedure of Example I was repeated with the exception that there were selected 680 grams of PMMA polymer coating with 18 weight percent of conductive CONDUCTIVE SC ULTRA™ carbon black, obtained from Columbian Chemicals, dispersed therein, the tribo was a positive 40, and the conductivity was about $8\times10^{-7}$ (ohm-cm)$^{-1}$.

EXAMPLE VIII

The procedure of Example VII was repeated with the exception that there were selected two polymer coatings of PMMA/18 weight percent carbon black and PMMA with 70 weight percent of tin oxide in a ratio of 75/25 PMMA/carbon black:PMMA/tin oxide, the tribo was a positive 27, and the conductivity was about $3\times10^{-9}$ (ohm-cm)$^{-1}$.

EXAMPLE IX

The procedure of Example VIII was repeated with the exception that the ratio was 50/50 PMMA/carbon black:PMMA/tin oxide, the tribo was a positive 19, and the conductivity was about $1.9\times10^{-8}$ (ohm-cm)$^{-1}$.

EXAMPLE X

The procedure of Example IX was repeated with the exception that the ratio was 25/75 PMMA/carbon black:PMMA/tin oxide, the tribo was a positive 12, and the conductivity was about $3\times10^{-9}$ (ohm-cm)$^{-1}$.

With further reference to the above Examples, the conductivity values were obtained as indicated herein. Specifically, these values were generated by the formation of a magnetic brush with the prepared carrier particles. The brush was present within a one electrode cell consisting of the magnet as one electrode and a nonmagnetic steel surface as the opposite electrode. A gap of 0.100 inch was maintained between the two electrodes and a 10 volt bias was applied in this gap. The resulting current through the brush was recorded, and the conductivity was calculated based on the measured current and geometry.

More specifically, the conductivity in mho-cm$^{-1}$ was the product of the current, and the thickness of the brush, about 0.254 centimeters divided by the product of the applied voltage, and the effective electrode area.

With insulating developers, there were usually obtained images of high copy quality with respect to both lines and halftones, however, solid areas were of substantially lower quality, in contrast, with conductive developers there were achieved enhanced solid areas with low line resolution and inferior halftones.

With respect to the triboelectric numbers in microcoulombs per gram, they were determined by placing the developer materials in an 8 ounce glass jar with 3.0 percent by weight of toner compositions, placed on a Red Devil Paint Shaker and agitated for 10 minutes. Subsequently, the jar was removed and samples from the jar were placed in a known tribo Faraday Cage apparatus. The blow off tribo of the carrier particles was then measured.

Also, in embodiments the present invention relates to the addition of nanocrystalline particles, with a diameter of, for example, from about 30 to about 100 nanometers, of high work function metals to carrier coating polymer, or polymers. Examples of metals that can be selected include aluminum, nickel, iron, gold, silver, and the like, which metals are available from Ultram International, Denver, Colo. The addition of high work function components to a carrier polymer enables, it is believed, a carrier which is both conductive, and which will alter the toner charge to, for example, a high positive charge while not impacting in a major manner the mechanical toughness of the polymer coating.

Other embodiments and modifications of the present invention may occur to those of ordinary skill in the art subsequent to a review of the present application and the information presented herein; these embodiments and modifications, as well as equivalents thereof, are also included within the scope of this invention.

What is claimed is:

1. A conductive carrier composition comprised of a core with a coating thereover consisting essentially of a mixture of first and second polymers, and wherein the first polymer contains a conductive component, and the second polymer contains a metal oxide, and wherein said carrier composition possesses a substantially constant conductivity of from about $10^{-9}$ (ohm-cm)$^{-1}$ to $10^{-7}$ (ohm-cm)$^{-1}$ and a positive triboelectric charging value of from about 5 microcoulombs per grams to about 40 microcoulombs per gram, and wherein the conductive component and the metal oxide are tribocontrast pigments that are not in close proximity in the triboelectric series, and wherein said conductive component and said metal oxide are dispersed in said polymers.

2. A carrier in accordance with claim 1 wherein the ratio of the first polymer with conductive component to the second polymer with metal oxide is from 50/50 to 75/25.

3. A carrier in accordance with claim 1 wherein the conductive component is carbon black and the metal oxide is tin oxide.

4. A carrier in accordance with claim 2 wherein the conductive component is carbon black, the metal oxide is tin oxide, and the ratio of the first polymer with conductive component to the second polymer with metal oxide is from 1/99 to 99/1.

5. A carrier in accordance with claim 4 wherein the first and second polymer are comprised of polymethylmethacrylate.

6. A carrier in accordance with claim 1 wherein said first polymer is polymethyl methacrylate and said second polymer is polymethyl methacrylate, and said conductive component for said first polymer is carbon black, and said metal oxide is tin oxide, and wherein said carbon black is present in an amount of 18 weight percent and said tin oxide is present in an amount of 70 weight percent, and wherein the conductivity is $3\times10^{-9}$ (ohm-cm)$^{-1}$ and the triboelectric charging value is a positive 27 microcoulombs per gram.

7. A carrier in accordance with claim 1 wherein the first polymer is present in an amount of from about 10 percent by weight to about 90 percent by weight, and the second polymer is present in an amount of from about 90 percent by weight to about 10 percent by weight.

8. A carrier in accordance with claim 1 wherein the first polymer is present in an amount of from about 40 percent by weight to about 60 percent by weight, and the second polymer is present in an amount of from about 60 percent by weight to about 40 percent by weight.

9. A carrier in accordance with claim 4 wherein the carbon black is dispersed in the first polymer in an amount of from about 10 to about 50 weight percent, and the tin oxide is dispersed in the second polymer coating in an amount of from about 25 to about 75 weight percent.

10. A carrier composition in accordance with claim 1 wherein the core is selected from the group consisting of iron, ferrites, steel and nickel.

11. A developer composition comprised of a conductive carrier composition comprised of a core with a coating thereover consisting essentially of a mixture of first and second polymers, and wherein the first polymer contains a conductive component, and the second polymer contains a metal oxide, and wherein said carrier composition possesses a substantially constant conductivity of from about $10^{-9}$ (ohm-cm)$^{-1}$ to $10^{-7}$ (ohm-cm)$^{-1}$ and a positive triboelectric charging value of from about 5 microcoulombs per grams to about 40 microcoulombs per gram, and wherein the conductive component and the metal oxide are tribocontrast pigments that are not in close proximity in the triboelectric series, and wherein said conductive component and said metal oxide are dispersed in said polymers, and a toner composition comprised of toner resin particles and pigment particles.

12. A developer composition in accordance with claim 11 wherein the toner resin particles are comprised of styrene polymers.

13. A developer composition in accordance with claim 12 wherein the styrene polymers are selected from the group consisting of styrene methacrylates and styrene acrylates.

14. A developer composition in accordance with claim 11 wherein the toner resin particles are selected from the group consisting of polyesters and styrene butadienes.

15. A developer composition in accordance with claim 11 wherein the pigment particles are carbon black.

16. A developer composition in accordance with claim 11 wherein the toner contains therein charge enhancing additives.

17. A developer composition in accordance with claim 16 wherein the charge enhancing additive is selected from the group consisting of alkyl pyridinium halides, organic sulfate and sulfonate compositions, and distearyl dimethyl ammonium methyl sulfate.

18. A developer composition in accordance with claim 11 wherein the first polymer is present in an amount of from about 40 percent by weight to about 60 percent by weight, and the second polymer is present in an amount of from about 60 percent by weight to about 40 percent by weight.

19. A process for the preparation of carrier particles with substantially stable conductivity parameters consisting essentially of (1) mixing carrier cores with a polymer mixture consisting essentially of from about 10 to about 90 percent by weight of a first polymer containing a conductive component, and from about 90 to about 10 percent by weight of a second polymer containing a metal oxide; (2) dry mixing the carrier core particles and the polymer mixture for a sufficient period of time enabling the polymer mixture to adhere to the carrier core particles; (3) heating the mixture of carrier core particles and polymer mixture to a temperature of between about 200° F. and about 550° F., whereby the polymer mixture melts and fuses to the carrier core particles; and (4) thereafter cooling the resulting coated carrier particles, and wherein said carrier composition possesses a substantially constant conductivity of from about $10^{-9}$ (ohm-cm)$^{-1}$ to $10^{-7}$ (ohm-cm)$^{-1}$ and a positive triboelectric charging value of from about 5 microcoulombs per grams to about 40 microcoulombs per gram, and wherein the conductive component and the metal oxide are tribocontrast pigments that are not in close proximity in the triboelectric series, and wherein said conductive component and said metal oxide are dispersed in said polymers.

20. A process in accordance with claim 19 wherein the carrier core is steel.

21. A process in accordance with claim 20 wherein the carrier core is selected from the group consisting of iron and ferrites.

22. A process in accordance with claim 19 wherein the polymer mixture selected is comprised of from about 40 percent by weight to about 60 percent by weight of the first polymer, and from about 60 percent by weight to about 40 percent by weight of the second polymer; the conductive component is carbon black, and the metal oxide is tin oxide.

23. A process in accordance with claim 22 wherein the triboelectric charging value of the resulting carrier particles is from about 5 microcoulombs per gram to about 50 microcoulombs per gram, the conductive component is carbon black, the metal oxide is tin oxide, and the first and second polymer are comprised of polymethylmethacrylate.

24. A process in accordance with claim 22 wherein the coating is continuous, and is present in a thickness of from about 0.2 micron to about 1.5 microns.

25. A process in accordance with claim 22 wherein the polymer mixture is heated for a period of from about 10 minutes to about 60 minutes, and the carrier core particles have an average particle diameter of between about 30 microns and about 200 microns.

26. A process in accordance with claim 20 wherein the carrier core has a surface area of at least 200 cm$^2$ per gram, and up to 1,000 cm$^2$ per gram.

27. A process in accordance with claim 22 wherein the polymer mixture adheres to the carrier core particles by impaction, or wherein the polymer mixture adheres to the carrier core by electrostatic attraction.

28. A method of formulating images consisting essentially of generating an electrostatic latent image on a photoconductive imaging member; thereafter developing this image with a developer composition consisting essentially of a conductive carrier composition comprised of a core with a coating thereover consisting essentially of a mixture of first and second polymers, and wherein the first polymer contains a conductive component, and the second polymer contains a metal oxide, and wherein said carrier composition possesses a substantially constant conductivity of from about $10^{-9}$ $(ohm\text{-}cm)^{-1}$ to $10^{-7}$ $(ohm\text{-}cm)^{-1}$ and a positive triboelectric charging value of from about 5 microcoulombs per grams to about 40 microcoulombs per gram, and wherein the conductive component and the metal oxide are tribocontrast pigments that are not in close proximity in the triboelectric series, and wherein said conductive component and said metal oxide are dispersed in said polymers; subsequently transferring the developed image to a supporting substrate; and thereafter affixing the image thereto.

29. A method in accordance with claim 28 wherein sequential image development is accomplished by continuously generating electrostatic latent images on the imaging member, and thereafter developing each of the images formed.

30. A carrier composition in accordance with claim 1 wherein the difference in electronic work function values between the first and second polymer is at least 0.2 electron volt.

31. A carrier composition in accordance with claim 1 wherein the first and second polymers are selected from the group consisting of polystyrene, tetrafluoroethylene, polyethylene, polyvinyl chloride, polyvinyl acetate and polymethylmethacrylate.

32. A developer composition in accordance with claim 15 wherein the carrier core coating is comprised of first and second polymers selected from the group consisting of polystyrene and tetrafluoroethylene; polyethylene and tetrafluoroethylene; polyethylene and polyvinyl chloride; polyvinyl acetate and tetrafluoroethylene; polyvinyl acetate and polyvinyl chloride; polyvinyl acetate and polystyrene; and polyvinyl acetate and polymethyl methacrylate.

* * * * *